United States Patent [19]

Peter

[11] 4,231,334

[45] Nov. 4, 1980

[54] METHOD AND APPARATUS FOR DETERMINING THE PROPORTIONS OF THE CONSTITUENTS OF THE AIR-FUEL MIXTURE SUPPLIED TO AN INTERNAL COMBUSTION ENGINE

[75] Inventor: Cornelius Peter, Stuttgart, Fed. Rep. of Germany

[73] Assignee: Robert Bosch GmbH, Stuttgart, Fed. Rep. of Germany

[21] Appl. No.: 890,163

[22] Filed: Mar. 27, 1978

[30] Foreign Application Priority Data

Mar. 30, 1977 [DE] Fed. Rep. of Germany ..... 2713988

[51] Int. Cl.[3] ..... F02M 25/06

[52] U.S. Cl. ..... 123/440; 123/437

[58] Field of Search ..... 123/119 EC, 119 EE, 123/32 EA, 32 EB, 32 ED, 119 A, 119 R; 60/276, 285

[56] References Cited

U.S. PATENT DOCUMENTS

| | | | |
|---|---|---|---|
| 3,782,347 | 6/1974 | Schmidt et al. | 60/276 |
| 3,861,366 | 1/1975 | Masaki et al. | 123/119 EC |
| 3,923,016 | 12/1975 | Hoshi | 123/32 CE |
| 4,000,614 | 1/1977 | Abthoff et al. | 60/28 J |
| 4,127,088 | 11/1978 | Ezue | 60/285 |
| 4,134,375 | 1/1979 | Koseki et al. | 123/119 EC |
| 4,149,502 | 4/1979 | Johnson et al. | 123/119 EC |

*Primary Examiner*—Charles J. Myhre
*Assistant Examiner*—Raymond A. Nelli
*Attorney, Agent, or Firm*—Edwin E. Greigg

[57] ABSTRACT

A method and apparatus for determining the proportions of the air-fuel mixture constituents supplied to an internal combustion engine from a mixture preparing device such as a carburator, a fuel injection device or other suitable mixture preparing device. The method according to the invention serves to simplify the processing of output signals that are supplied to a mixture preparing device having at least two λ sensors. The invention is especially suitable for use with large engines with several exhaust conduit systems, such as so-called V-engines, in which generally there is an unequal mixture distribution between the two rows of cylinders. By employing at least two λ sensors in the exhaust gas conduit system for monitoring the exhaust gas composition, one succeeds in determining the mixture composition of the air-fuel mixture applied to all cylinders, and in influencing the air-fuel mixture in a suitable supplementary manner by a feed back of the actual value signals generated by the λ sensors to the fuel preparation device, so that a desirable overall exhaust gas average value can be achieved. The apparatus employs two integrators and suitable logic circuitry for applying the λ sensor signals to the integrators in such a manner that one integrator regulates the entire mixture in the desired direction, according to the sensor signals supplied to it, while the other integrator sets the amplitude of the oscillation fluctuations at a value that corresponds to the λ differential.

14 Claims, 2 Drawing Figures

METHOD AND APPARATUS FOR DETERMINING THE PROPORTIONS OF THE CONSTITUENTS OF THE AIR-FUEL MIXTURE SUPPLIED TO AN INTERNAL COMBUSTION ENGINE

BACKGROUND OF THE INVENTION

The invention relates to a method and apparatus for determining the proportions of the air-fuel mixture constituents supplied to an internal combustion engine by a mixture preparing device. The apparatus has at least two λ or oxygen sensors arranged in the exhaust gas conduit system of the engine. The output signals of the oxygen sensors are integrated and supplementarily used in the determination of the air-fuel mixture proportions.

Of special concern is an internal combustion engine which utilizes a fuel injection device as the mixture preparing device, which precalculates the quantity of fuel to be delivered by using the rpm and the air flow rate delivered to the internal combustion engine.

Mixture preparing devices are already known, which operate with a single λ sensor in the exhaust gas conduit system. In such devices, the λ sensor output signal is evaluated in such a manner that it is supplementarily used, after processing by a subsequently arranged integrator, to precisely determine the proportions of the constituents of the air-fuel mixture supplied to an internal combustion engine. The output signal of the λ sensor whereby forms the actual value signal of a regulating system, which includes the internal combustion engine itself as the regulated system.

It has also been suggested, for mixture preparing devices used with the more complicated engines, to operate with at least two λ sensors arranged at suitable locations in the engines or the exhaust gas conduit systems thereof; or to arrange at least two λ sensors at various locations in an exhaust gas conduit system for a more comprehensive determination of the exhaust gas composition. The evaluation of the output signals of the two λ sensors can thereby take place with the aid of a single integrator circuit, whereby the sensor signals are alternately switched in a cyclical manner to the input of the integrator circuit. The single integrator circuit then delivers its output signal for the mixture composition to the mixture preparing device. In this manner, however, one does not exhaust the many possibilities that are offered by the use of two λ sensors in a control situation, and in particular, with such an arrangement the dynamic behavior of the mixture preparation cannot be improved.

The use of two separate units for a certain number of cylinders in larger internal combustion engines, for example, for half of the cylinders, has also been suggested. Thus in V-engines a separate mixture preparing device is provided for each row of cylinders. This solution, however, is very expensive, and cannot optimally employ the special characteristics that the use of two λ sensors makes available.

OBJECT AND SUMMARY OF THE INVENTION

It is a principal object of the invention to provie a method and apparatus according to which a better control of the proportions of the air-fuel mixture constituents supplied to an internal combustion engine by a mixture preparing device can be effected.

Steps are taken in the regulation of the overall exhaust gas average value to ensure that the mixture composition, which is calculated by the mixture preparing device, is fluctuated at a predetermined amplitude about a desired λ value. The apparatus according to the invention for carrying out such a procedure includes two integrators, to which the sensor signals are supplied by means of a suitable logic circuit in such a manner that one integrator regulates the entire mixture in the desired direction, according to the sensor signals supplied to it, while the other integrator sets the amplitude of the oscillation fluctuations at a value that corresponds to the λ differential.

The novel method has the advantage that only one air flow rate meter and only one control device is necessary, even in very large engines with several rows of cylinders, such as V-engines utilizing fuel injection. In such engines, the injection valves can be opened in parallel, i.e. simultaneously by means of a common end stage. Rather than having two independent mixture preparing devices, one for each row of cylinders, one λ sensor per each cylinder row is used and built into the system, resulting in substantially lower production costs.

Also advantageous is the resulting improved dynamic behavior of the engine, whereby the storage effect of a catalyzer arranged in the exhaust gas conduit system is used for averaging or regulating the overall exhaust gas average value to a desired λ value of preferrably approximately $\lambda=1$.

In the apparatus according to the invention for carrying out the method there results the advantage, that the regulation can be carried out either digitally or with analogs, although, on the basis of the conception of the invention, a digital solution is preferred. The digital solution can be realized in a relatively simple manner by the use of integrated modules.

It is also advantageous that the slope of the integrators, and the frequency of the forced fluctuations, which are superimposed on the λ output signal of one of the integrators, can be formed to be proportional to the rpm, thus attaining an optimal adaptation over the entire rpm range (adaptive time constant).

DESCRIPTION OF THE PREFERRED EMBODIMENT

Figures 1, 2:
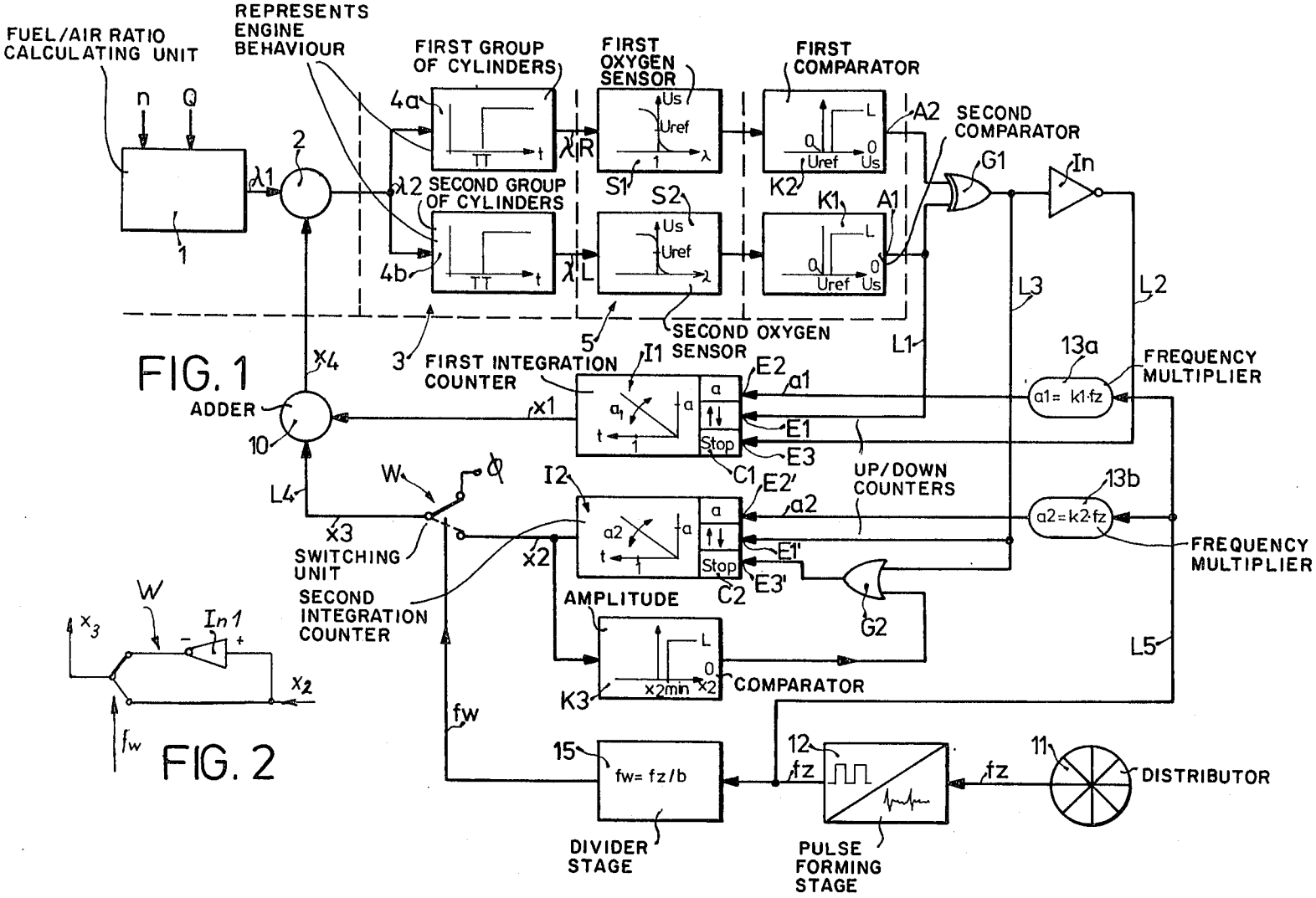
FIG. 1 schematically illustrates the engine and operating unit and includes a block diagram of the control circuit with the λ sensors and digital components in circuit.
FIG. 2 illustrates an alternative embodiment of the switch W of FIG. 1.

In FIG. 1 there is shown an operating unit 1, which calculates the air-fuel ratio which determines the fuel quantity to be delivered to the internal combustion engine. The unit 1 which is a known unit, such as is disclosed, for example, in U.S. Pat. No. 3,750,631, uses as input conditions the value of the rpm (n), and the air flow rate (Q) of the internal combustion engine for this calculation. The thus calculated value, designated λ1, for the fuel mixture preparation is applied to a circuit location 2, which can generally be designated as an adding stage. A fluctuating, i.e. superimposed forced oscillating actual value signal, designated X4, from a control stage is applied to the adding stage 2 for correcting the λ1 value. This results in a corrected signal λ2 at the output of the adding stage 2, which is supplied to the internal combustion engine 3. The internal combustion engine 3 is shown schematically by the two blocks 4a and 4b, which respectively represent a right cylinder row (4a) and a left cylinder row (4b). These blocks also show the time delay that is thus produced in each row of cylinders, in the form of the small diagram drawn in the blocks. This time delay relates to the dead time of the engine, which results when the internal combustion engine is supplied on the input side with a mixture composition that is changed in its proportions relative to the immediately preceding mixture composition supplied. This change of the mixture composition is to be simultaneously detected by a λ sensor in the exhaust gas conduit, i.e., the λ sensor "notes" the change that occurred as to the constituent parts of the mixture at a later point in time TT, namely after the dead time of the engine has ended.

During the detailed discussion of the exemplary embodiment of the invention that follows, the mixture supply means of a large V-engine with two rows of cylinders will serve as a reference. It should be understood, however, that the basic principle of the invention and the individual circuit components can also be used in other engines, which justify the employment of two λ sensors, or where the use of two λ sensors appears to be desirable.

Each row of cylinders of the internal combustion engine 3 has a succeeding λ sensor 5, which is designated as λ sensor S1 for the right side cylinders and as λ sensor S2 for the left side cylinders. According to the diagram, the λ sensor circuit blocks show the curve of the sensor voltage vs the λ ratio with the characteristic voltage jump at $\lambda=1$. On the input side of the λ sensors 5, the $\lambda_R$ from the right side cylinders is led to the λ sensor S1, and the $\lambda_L$ of the left side cylinders is led to the λ sensor S2. On the output side the λ sensors are connected with subsequently located comparators or threshhold value switches K1 and K2, which switch a constant or perhaps temperature-dependent reference voltage Uref in opposition to the output signals of the λ sensors, and produce an L-signal (log 1) or an O-signal (log 0) on their output side when the output signal of the respective sensors is greater than or lesser than the opposing reference voltage.

In other words, this means that output signals that are basically in the form of a binary code are available for the outputs A1 and A2 of the comparators K1 and K2 as logic switch signals, so that the remaining processing in the exemplary embodiments illustrated preferably takes place in the form of a digital circuit, as mentioned above. It must be understood, however, that with the use of the same operative principle one can also proceed with analogs. The use of analogs, however, need not be discussed in detail, because the use of analog modules, such as integrators and the like is really quite well known and can therefore be used by the specialist having knowledge of the present invention.

As shown the output signal A1 of the comparator K1 is led by means of a line L1 directly to a first integrator I1 for processing. This integrator can produce a corresponding gradually increasing output signal, in other words, it can be built, for example, in the form of a known so-called Miller integrator. In the illustrated exemplary embodiment, digital solutions are preferrably used, and the integrator module I1 is therefore formed as a pre-adjustable UP/Down binary counter, whereby the input E1, to which the comparator output signal A1 is led, is the direction counting input of the counter C1. In other words, the signal that is led to the input E1 determines the counting direction of the counter. For example, when a comparator output signal of log 1 state is present the counter C1 counts upward and with the signal A1=log 0 state the counter counts downward. The counting input of the counter C1 is designated as E2.

The output signals A1 and A2 of the comparators are in addition led to the respective inputs of an exclusive OR-gate G1, behind which in sequence is arranged a simple negating member, namely an inverter In. The output signal of the inverter travels through a line L2 to an additional input E3 of the counter C1, by means of which the counting process can be interupted. The output signal of the exclusive OR-gate G1 travels through the line L3 to the direction input E1′ of a second integrator I2, which can also be formed as a counter C2. The counting input of the counter C2 is designated as E2′, and its input that interupts the counting process is designated as E3′.

The output values X1 and X2 of the integrators I1 and I2 are combined e.g. superimposed by means of an adding stage 10. For this purpose an additional double throw switch or selector switch W is provided. The switch W switches between the respective value obtained by the integrator I2 and a zero value or zero signal. As shown in the alternate embodiment of FIG. 2, the switch W switches the polarity (plus/minus) of X2, by reason of the signal X2 passing through an inverter In1. This results in a fluctuating signal value X3 in the line L4 having a predetermined amplitude and frequency.

The other remaining circuit components are described below together with the explanation of the method of operation of the exhaust gas regulating circuit according to the invention using two λ sensors and only one control device.

We turn now to a specific property of exhaust gas catalyzers which are being used in internal combustion engines with exhaust limitations that are becoming increasingly strict. The catalyzers are being used more and more to clean the exhaust gas of undesirable substances. This type of exhaust gas catalyzer has a kind of gas reservoir capacity which in control technology may be described, in a first approximation, as a first-order delay. Thus, if one varies the composition of the combustible mixture around a predetermined nominal value, e.g. $\lambda=1$, at a relatively high frequency, for example at a frequency of $f_{min}>2$ Hz, then one can expect that the catalyzer will act on the exhaust gas composition to form an average value. This effect is what is being utilized in the present invention.

The two λ sensors S1 and S2 deliver the information concerning the exhaust gas composition in the left and right engine halves 4a and 4b. The control of the two integrators I1 and I2 takes place by means of the logic circuit from the gate G1, the inverter stage In and an additional OR-gate G2, whose output is connected with the input E3′ of the counter C2. By means of the input E1′ the counting process can be interupted.

The integrator I1 is formed in such a manner that its output signal X1 regulates the entire mixture in the lean direction, i.e., when both sensors S1 and S2 indicate a rich mixture. On the other hand a regulating of the entire mixture takes place in the rich direction when both λ sensors indicate a lean mixture. However, if one λ sensor indicates rich and the other indicates a lean mixture, or vice versa, then the integrator I1 remains at the value it previously had attained. Thus the following table results for the output signal X1 of the integrator I1:

| S1 | S2 | I1 ($T_1 = t_o + \Delta t$) |
|---|---|---|
| rich | rich | $x_1 = x_o + \Delta x$ |
| rich | lean | $x_1 = x_o$ |
| lean | rich | $x_1 = x_o$ |
| lean | lean | $x_1 = x_o - \Delta x$ |

In contrast to the above, the integrator I2 is formed in such a manner that its output signal X2 regulates the amplitude of the fluctuation i.e. the forced oscillation noted above, to a value that corresponds to the λ difference between the two rows of cylinders. Thus the following table is the result:

| S1 | S2 | I2 ($t_2 = t_o + \Delta t$) |
|---|---|---|
| rich | rich | $x_2 = x_o - \Delta x$ |
| rich | lean | $x_2 = x_o + \Delta x$ |
| lean | rich | $x_2 = x_o + \Delta x$ |
| lean | lean | $x_2 = x_o - \Delta x$ |

When the integrators are embodied as counters a counting frequency is necessary, which, according to an additional advantageous feature of the present invention, is proportional to the rpm of the internal combustion engine, so that the entire dynamic regulating behavior can be formed in an optimal manner over the whole rpm range of the internal combustion engine. In other words, in the present invention the time constants of the system automatically change in an adapting, rpm-proportional manner. A suitable rpm-proportional signal is used to produce the counting frequencies for the counters C1 and C2, which signal already exists if we are dealing with a mixture preparing device utilizing a fuel injection device. This type of signal can also be produced by monitoring a certain marking on the cam shaft by means of a suitable transmitting system. In the shown exemplary embodiment, a signal of frequency $f_z$ is developed from the operation of the distributor 11 of the internal combustion engine and led to a pulse forming stage 12, which produces a suitable rectangular wave form for the oscillation. This ignition frequency representing wave train travels through the line L5 to interposed circuit blocks 13*a* and 13*b*, which produce the counting pulse series a1 and a2. These in turn are to be led to the counting inputs E2 and E2′ of the counters C1 and C2, and comprise the ignition frequency $f_z$ multiplied by a suitable factor K1 and K2.

This results in the following method of operation of these counters. If, for example, the output signal A1 of the comparator K1 has the value log 1, then the upward counting process for the counter C1 is initiated and the counter counts the counting pulse series a1. The counting speed can be altered because of the changing frequency of the counting pulse series (rpm dependence), and an increase of the integration caused thereby. The counter C1, however, can only count in the direction determined by the input signal at its input E1 as long as both sensor output signals A1 and A2 are identical. In other words the subsequently arranged exclusive OR-gate circuit G1 stops the counting process by means of the inverter In when the input signals led thereto differ, for in this instance the output signal of the exclusive OR-gate G1 indicates a log 1 state and the inverse log 0 state is applied to the input E3 of the counter C1 and interupts the counting process. The method of operation of the integrator I1 for the other possibities noted in the above table is thus assured, and the output signal X1 can be used to regulate the entire mixture in the respectively appropriate direction.

In contrast to the above, an upward counting command is given by the log 1 state to the counter C2 only when, and as long as, the λ sensor output signals, or more correctly stated, the output signals of the subsequently located comparators, are different, for only then does the value log 1 result at the output of the exclusive OR-gate G1. If both λ sensors give the same output signals, C2 counts downward, provided $x2 > x2_{min}$. However, when $x2 \leqq x2_{min}$, then a stop order is given to the counter C2 by the OR-gate G2, so that this comes to a stop. The counter C2 remains stopped when the output signal x2 generated by the integrator I2 attains a defined limiting value, which can lie at around 0.01, for example. This means that the minimal amplitude of the λ-forced oscillations is equal to this value of 0.01. This function is attained by the comparator K3, to which the output signal X2 of the integrator I2 is led, and which produces a suitable stop signal on its output side, when the amplitude falls below the limiting value. This signal is led to the counter C2 to interrupt its counting process.

The frequency of the λ-forced oscillations is determined by the frequency at which the double throw switch W switches back and forth on its input side between x2 and 0 potential (FIG. 1), or between plus x2 and minus x2 potential (FIG. 2). Because this forced oscillation frequency or wobble frequency should preferably also be proportional to the rpm, a frequency divider circuit 15 is provided, which produces on its output side a double throw switch frequency $f_w$ which corresponds to a fraction of the output frequency of the pulse forming stage 12. The reduction factor b thereby can be the number of cylinders of the internal combustion engine. It is desirable, that the frequency of this λ-forced oscillation be as high as possible, such as one period per every two cam shaft revolutions (corresponding to one period per every two injection operations). Thus, if both rows of cylinders produce a similar λ signal, then both sensors are running synchronously and the integrator I2 integrates in the negative direction, that is in the direction of a decreasing amplitude of the λ-forced oscillation. This is accomplished by leading the output signal of the exclusive OR-gate G1, which in this case has the value log 0, to the counting direction input E1′ of the counter C2. In control technology a value of $x2_{min} \iota \Delta x1/TT$ has proven to be optimal. Thus the result:

| $x_o$ | I2 ($t_2 = t_o + \Delta t$) |
|---|---|
| $> x2_{min}$ | $x_2 = x_o - \Delta x$ |
| $\leqq x2_{min}$ | $x_2 = x_o$ |

The adding stage 10 can be formed as a binary full adder, whereby in the preferred embodiment even high demands on the device's capacity to resist malfunctions is met by means of digital modules.

One obtains a regulation of the entire exhaust gas average value to the desired λ value, i.e. to λ=1, by means of the defined oscillation of the mixture composition around a desired λ value, such as λ=1, that is, by means of the superposition of the output signal x1 of the first integrator I1 with a forced oscillation signal, whose amplitude corresponds to the λ difference between the two rows of cylinders, and whose frequency is proportional to the rpm. To this end the gas storage effect of the catalyzer is used for averaging.

Neither the mixture preparaing device, which as noted above can be a carburetor, a fuel injection device, or the like, nor the exhaust gas catalyzer are shown since details of their structure are not necessary for an understanding of the invention.

What is claimed is:

1. A method for determining the proportions of the air-fuel mixture constituents supplied to an internal combustion engine having an exhaust gas conduit system and a mixture preparing device associated therewith, said air-fuel mixture constituents being supplied by the mixture preparing device which has at least two oxygen sensors arranged in the exhaust gas conduit system, comprising the steps of:

detecting the rpm of and the air flow rate to the engine, calculating the air-fuel ratio which determines the fuel quantity to be delivered to the engine, and generating a signal representative of this air-fuel ratio;

integrating the output signals from each of the oxygen sensors; and applying the integrated output signals to the generated representative signal of the air-fuel ratio and oscillating the representative signal about a predetermined air-fuel ratio value and at a predetermined amplitude, thereby regulating the average value of the overall exhaust gas composition to the predetermined air-fuel ratio value.

2. The method as defined in claim 1, wherein the predetermined amplitude is a function of the difference in the output signals from the oxygen sensors.

3. The method as defined in claim 1, wherein an exhaust gas catalyzer operates on the engine exhaust, and wherein the method further comprises the step of:

producing an average value of the overall exhaust gas composition using the storage effect of the catalyzer.

4. The method as defined in claim 1, wherein the engine comprises a V-block with two rows of cylinders and a plurality of injection valves, and wherein the method further comprises the steps of:

providing each row of cylinders with an oxygen sensor; and opening the injection valves simultaneously.

5. An apparatus for determining the proportions of the air-fuel mixture constituents supplied to an internal combustion engine having an exhaust gas conduit system and a mixture preparing device associated therewith, said air-fuel mixture constituents being supplied by the mixture preparing device, said apparatus comprising:

means for generating a signal representative of the air-fuel ratio, which determines the fuel quantity to be delivered to the engine, on the basis of the rpm of and the air flow rate to the engine;

at least two oxygen sensors arranged in the exhaust gas conduit system of the engine;

a first and second integrator;

means connected between the oxygen sensors and the integrators for controlling said integrators based upon the output signals from the oxygen sensors such that said first integrator generates an output signal which maintains a constant value when the output signals of the oxygen sensors are different and an output signal which is greater or less than a constant value when the output signals of the oxygen sensors are the same, and said second integrator integrates upward when the output signals of the oxygen sensors are different and downward when the output signals of the oxygen sensors are the same;

a double-throw switch connected to the output of said second integrator; and means for oscillating said switch between its two positions, thereby oscillating the output from the second integrator at a predetermined amplitude, said oscillating output from the second integrator being applied to the output of the first integrator and the two outputs being applied to the output from said means for generating the air-fuel ratio representative signal, producing thereby a corrected signal for the mixture preparing device.

6. The apparatus as defined in claim 5, wherein the speed of integration of said first and second integrators is proportional to rpm.

7. The apparatus as defined in claim 5, wherein both integrators are embodied as counters, wherein said means for controlling said integrator counters includes a gate circuit connected on its input side to both oxygen sensors and on its output side to the second integrator counter for controlling its counting direction, and means for generating an rpm proportional counting frequency which is applied to the counting input of each integrator counter, and wherein the counting direction of the first integrator counter is controlled by the output signal of one of the oxygen sensors.

8. The apparatus as defined in claim 7, wherein said means for controlling said integrators further includes a pair of comparators each connected on their input side to a respective one of the oxygen sensors and on their output side to the gate circuit, and wherein the gate circuit is embodied as an exclusive OR-gate.

9. The apparatus as defined in claim 7, wherein both integrator counters include stop inputs to which signals that interrupt the counting sequence are applied, and wherein in the first integrator counter the counting sequence is stopped when the output signals of the oxygen sensors are different, and in the second integrator counter the counting sequence is stopped when a predetermined limiting value is attained.

10. The apparatus as defined in claim 9, wherein said means for controlling sais integrators further includes a comparator connected to the second integrator counter for stopping the counting sequence in the second integrator counter when the predetermined limiting value is attained.

11. The apparatus as defined in claim 7, wherein the means for generating an rpm proportional counting frequency includes a pulse train forming stage and a circuit block connected to each integrator counter and to the pulse train forming stage, and wherein the means for generating an rpm proportional counting frequency is connected to the engine distributor.

12. The apparatus as defined in claim 11, wherein the means for generating an rpm proportional counting frequency further includes a frequency divider connected to the output of the pulse train forming stage and to the double-throw switch.

13. The apparatus as defined in claim 5, wherein said means for controlling said integrator counters further includes an adding stage which has as its inputs the output from said first integrator and the oscillating output controlled by said switch and as its output an oscillating actual value regulating signal, and wherein the output controlled by said switch oscillates between o and the value of the output of said second integrator.

14. The apparatus as defined in claim 5, wherein said means for controlling said integrator counters further includes an adding stage which has as its inputs the output from said first integrator and the oscillating output controlled by said switch and as its output an oscillating actual value regulating signal, and wherein the output controlled by said switch oscillates between the positive and negative value of the output of said second integrator.

* * * * *